US005963767A

United States Patent [19]

Habets et al.

[11] Patent Number: 5,963,767

[45] Date of Patent: Oct. 5, 1999

[54] IMAGE PRINTING APPARATUS

[75] Inventors: Antonius H. M. Habets, Kessel; Ronald Fabel, Venlo; Cornelis W. M. Venner, Meijel, all of Netherlands

[73] Assignee: Oce-Technologies, B.V., Ma Venlo, Netherlands

[21] Appl. No.: 08/900,859

[22] Filed: Jul. 25, 1997

[30] Foreign Application Priority Data

Jul. 25, 1996 [NL] Netherlands ..... 1003680

[51] Int. Cl.[6] ..... G03G 15/08

[52] U.S. Cl. ..... 399/271; 346/74.7; 347/115

[58] Field of Search ..... 346/74.2, 74.5, 346/74.7; 347/112, 115, 117; 399/267, 270, 271

[56] References Cited

U.S. PATENT DOCUMENTS

| | | | |
|---|---|---|---|
| 4,446,471 | 5/1984 | Yano | 346/74.2 X |
| 4,470,051 | 9/1984 | Springer | 346/74.5 |
| 4,646,108 | 2/1987 | Guerin | 346/74.7 |
| 4,901,087 | 2/1990 | Cherbuy | 346/74.2 |
| 4,931,815 | 6/1990 | Sato et al. | 347/116 |
| 5,384,592 | 1/1995 | Wong | 347/116 |

FOREIGN PATENT DOCUMENTS

| | | |
|---|---|---|
| 0304983B1 | 3/1989 | European Pat. Off. . |
| 0310209B1 | 4/1989 | European Pat. Off. . |
| 0373704B1 | 6/1990 | European Pat. Off. . |
| 0598566 | 1/1995 | European Pat. Off. . |
| 58-140265 | 8/1983 | Japan . |
| 1-297247 | 11/1989 | Japan . |
| 2-229059 | 9/1990 | Japan . |
| 7-304211 | 11/1995 | Japan . |

*Primary Examiner*—Fred L. Braun

[57] ABSTRACT

An image printing apparatus includes a number of image forming units for forming toner images of different colors in alignment on image receiving material in accordance with electronic image information signals fed to each image forming unit. Each image forming unit includes an image forming element rotatable about an axis of rotation and provided with a dielectric surface layer with adjacent electrode tracks in the direction of rotation. Each image forming unit further includes developing devices which include a linear developing magnet situated near the outer surface and parallel to the axis of rotation of the image forming element, toner feed devices for feeding a complete covering of electrically conductive and magnetically attractable toner powder to the image forming element, electrode track activating devices for applying a first or a second printing voltage between an electrode track and the magnet system in accordance with the image information signals to be fed to the image forming units. Toner powder on the passage of the electrode track along the developing magnet remains either on the image forming element or does not remain thereon in the event of a first or second printing voltage respectively on the electrode track. The image printing apparatus also includes at least one image forming unit provided with electronic image line correction devices for feeding image line correction signals to the electrode track activating devices in order to shift in time for each electrode track a printing period in which a printing voltage is applied to the electrode track in accordance with an image information signal.

20 Claims, 11 Drawing Sheets

| C | WRITE ROW | READ+S ROW | READ+S+COR ROW |
|---|---|---|---|
| C=1 | 10 | 5 | 7 |
| C=2 | 11 | 6 | 9 |
| C=3 | 12 | 7 | 8 |

S=5, COR(1)=2, COR(2)=3, COR(N)=1

FIG. 11(A)
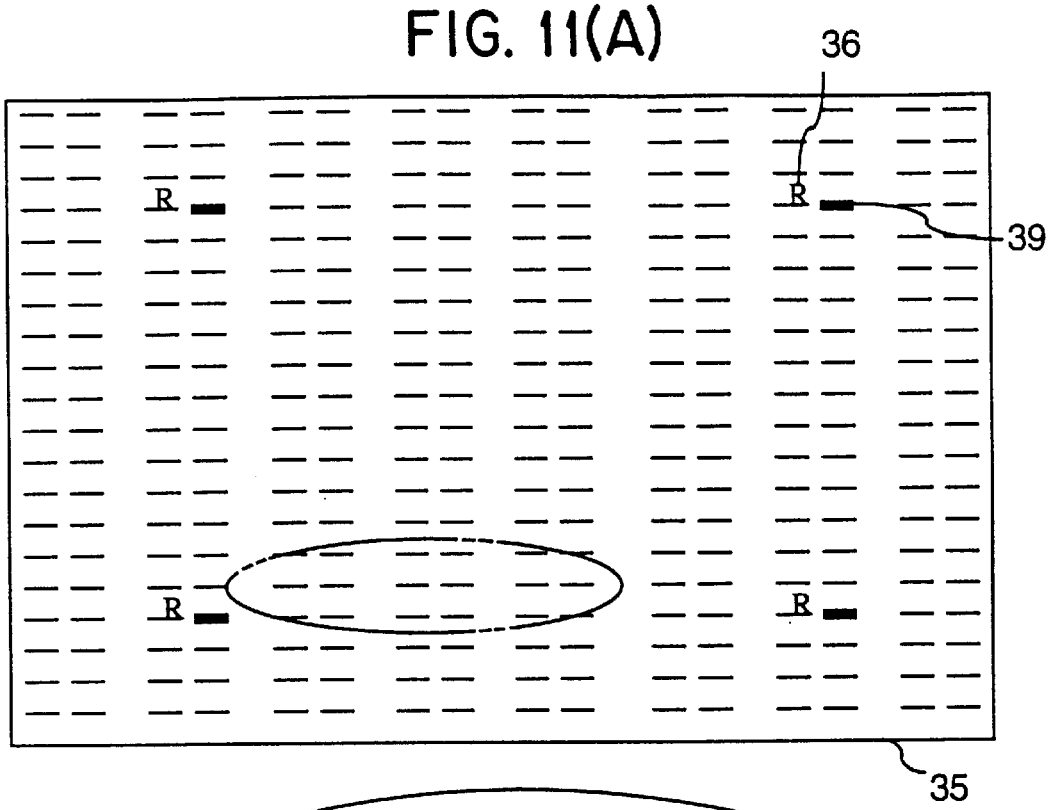
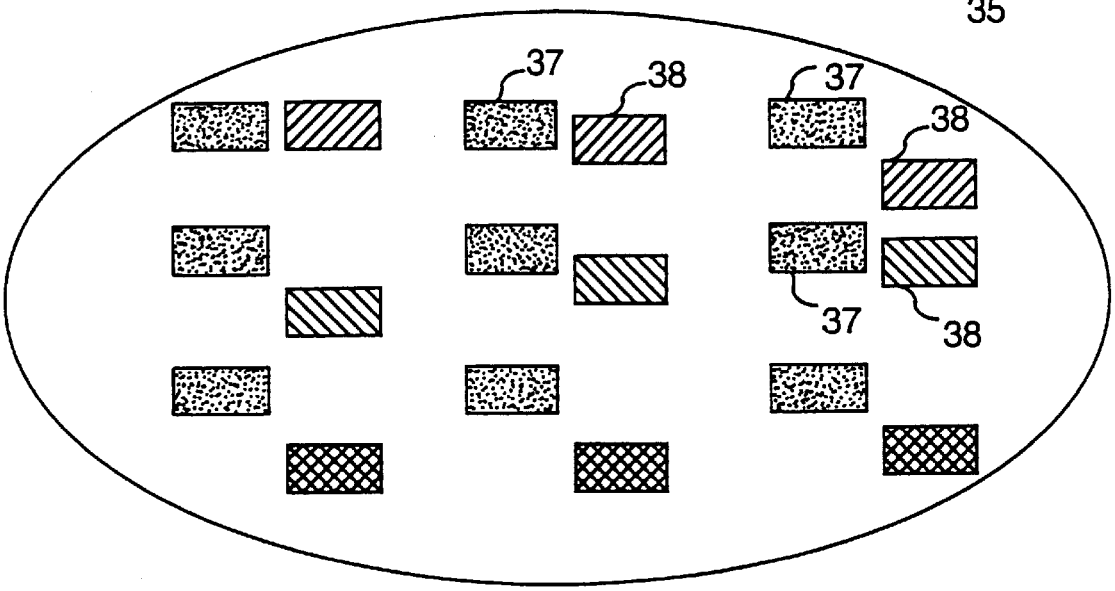
FIG. 11(B)

IMAGE PRINTING APPARATUS

BACKGROUND OF THE INVENTION

1. Field of the Invention

The invention relates to an image printing apparatus comprising a number of image forming units for forming toner images of different colors in alignment on an image receiving material in accordance with electronic image information signals fed to each image forming unit. Each image forming unit includes an image forming element rotatable about an axis of rotation and provided with a dielectric surface layer with electrode tracks therebeneath. Each image unit further includes developing means comprising a linear developing magnet situated near the outer surface and parallel to the axis of rotation of the image forming element, toner feed means for feeding electrically conductive and magnetically attractable toner powder to the image forming element, and electrode track activating means. The electrode activating means applies a first or a second printing voltage between an electrode track and the magnet system in accordance with the image information signals to be fed to the image forming units. Depending on the voltage, powder on the passage of the electrode track along the developing magnet toner either remains on the image forming element or does not remain thereon in the event of a first or second printing voltage respectively on the electrode track.

2. Description of Background Art

An image printing apparatus is described in European patent EP 0 310 209 in which, by the use of known toner feed means, toner powder is brought into contact with the image forming element from a toner reservoir over an entire image dimension. In a first embodiment, the image forming element is constructed as a rotatable cylindrical element. By maintaining a minimum feed voltage difference between the electrode tracks and the toner feed means the dielectric surface layer of the image forming element is charged via the electrically conductive toner powder. The toner powder in contact with the surface layer in these conditions is then retained by the resulting charge build-up in the dielectric surface layer. This part of the image forming element thus provided with an even layer of toner powder then passes a linear magnetic field formed by the linear developing magnet, the magnetic field extending axially and being sharply defined in the direction of rotation. The magnetic force exerted as a result is sufficient to draw the magnetically attractable toner powder from the image forming element. In one embodiment, the developing means are constructed as a linear magnet disposed to be stationary and extending over the entire axial direction of the image forming element, with a rotating sleeve extending therearound, the direction of rotation thereof being opposite to that of the image forming element. European patent EP 0 304 983 describes developing means of this kind. The toner powder drawn from the image forming element by the magnetic field will be transported back to the toner reservoir by the rotating sleeve.

If an extra voltage difference is now applied between the magnet system and the image forming element, the extra electric force exerted thereon can cause the toner powder to be retained on the image forming element, despite the magnetic force exerted thereon by the magnet system. This printing voltage can be applied for a short printing period to any electrode track. As a result, the toner coverage on the image forming element is limited by the electrode track in the axial direction and by the printing period in the direction of rotation. Thus a printing voltage applied simultaneously to all the electrode tracks for a minimum printing period results, for example, in a toner coverage in the form of a line parallel to the axis of rotation of the image forming element.

A toner image thus developed by an image forming unit can be transferred by suitable toner transfer means to the image receiving material, with or without the use of an intermedium. This transfer can be effected by pressure or by electrostatic transfer. The European patent EP 0 373 704, for example, describes an embodiment with pressure transfer and an intermediate element.

Particularly in the case of color printing it is important to obtain an accurate positioning of the different color separation images, such positioning being constant over the entire image dimension. In the case of a mixed pattern consisting of different adjacent toner coverages in different colors, an undesirable color shift occurs when these areas cover one another. Alternatively, where two surfaces each of a different color adjoin, an undesirable boundary effect occurs or else the color of the image receiving material between the surfaces becomes visible.

In the case of pressure transfer with an intermediate element as described in European patent EP 0 373 704, in principle no toner powder is transferred from an image forming element over an existing layer of toner already applied by another image forming unit on the intermediate element. In this case, the balance of the mechanical and electrical forces is such that toner is transferred to the intermediate element if the latter is not yet covered with toner but remains on the image forming element if that is the case. In the event of incorrect mutual positioning of toner separation images, there is in that case the risk that less toner of a specific color will be transferred as a result of overlap.

The accurate positioning of color separation images is a known problem for which various solutions have been developed.

U.S. Pat. No. 4,931,815, for example, describes a color printing apparatus which successively prints a number of color separation images directly in alignment on a paper sheet. For this purpose, the paper sheet is conveyed along a straight transport path passing a number of cylindrical drums disposed along the path and provided with a photoconductive surface layer. A color separation image is developed on each photoconductive drum by means of a laser scanner, drum charging means and toner feed means. The color separation images developed thereon are then electrostatically transferred to the paper sheet.

The color printing apparatus described in the above patent is provided with a number of position detectors in the form of CCD's which are located after the photoconductive drums in the downstream direction and in which each CCD covers a part of the transport path. Each photoconductive drum then prints on the transport path a line parallel to the axis of the drum. The position detectors then detect any deviation in the direction of the transport path between the lines placed by the various photoconductor drums. The magnitude of this deviation is stored by means of a counter for each photoconductive drum. The time at which the image information to be fed to each laser scanner is read out is then corrected for this deviation. Consequently, the leading edges of each color separation image coincide, at least insofar as they are parallel and identical. Any skewing or bending of an image line reproduced by the photoconductive drums is not corrected as a result. All the image signals to be fed to the scanner means of a photoconductive drum in fact undergo the same shift.

U.S. Pat. No. 5,384,592 also describes a color printing apparatus with means for correcting imperfect alignment of the color separation images. By exposure means such as a laser scanner or an LED array, a charge image is formed for each color on a cylindrical photoconductor. Toner feed means are used to form toner covering corresponding to the charge image, either directly on a paper sheet passing along the photoconductors by means of a conveyor belt, or indirectly by transfer to a collecting belt taken past the photoconductors. Position sensors in the form of linear CCD arrays are also disposed in the downstream direction for scanning the edges of the conveyor belt or collecting belt. By disposing markers on both edge zones by means of the various photoconductors, these position sensors can detect whether there is a relative shift in the direction of transport, skewing or a shift perpendicular to the direction of transport between markers of different photoconductors. In the case of a shift in the direction of transport, a correction is made by correcting the starting signal for an image. In the case of skewing, correction is obtained, in the case of apparatus with laser scanning means, by turning a deflection mirror, and in the case of an arrangement with LED array, by turning the array with automatic movement means. In the case of a shift perpendicular to the direction of the transport, a start signal for an image line is corrected.

However, none of the color printing means described in the above patents can correct any deformation of an image line or skewing without additional displacement means. Although the latter patent points out that the markers must not be disposed too far apart at the two edges in view of the presence of any bending perpendicular to the direction of transport, it gives no complete image line correction of this bending. It is however precisely in the case of a developing magnet of the kind referred to in the preamble that considerable requirements must be satisfied in respect of the straightness of the magnetic field generated thereby, since this is largely responsible for the straightness of an image line produced as a result. It must also be remembered that a minimum dimension of a toner covering reproduced in the direction of transit can at most be just a few tens of micrometers in the case of an image resolution of 1600 dpi. There is also a disturbance of the imaging by the toner displacement between the developing magnet and the image forming element.

SUMMARY OF THE INVENTION

The color printing apparatus according to the invention has as its object to obviate the above disadvantages and deficiencies and to this end at least one image forming unit is provided with electronic image line correction means for feeding image line correction signals to the electrode track activating means in order to shift in time for each electrode track a printing period in which a printing voltage is applied to the electrode track in accordance with an image information signal.

Since the time of activation of each electrode track can now be corrected separately, it is not only possible to achieve overall a shift in the transport direction or skewing of a color separation image, but also a local shift in the direction of transport. As a result it is possible to correct for bending of an image line perpendicular to the direction of transport as introduced during printing. As a result of this possibility, the developing means do not have to satisfy such high requirements and particularly the requirements in respect of linearity of the linear developing magnet.

One advantageous embodiment is that the magnitude of the shift of the printing period for each electrode track is directly proportional to the axial position of the electrode track on the image forming element. An image line correction of a skewed position does not now have to be performed with mechanical means.

In another advantageous embodiment, the magnitude of the shift of the printing period for each electrode track is dependent of the axial position of the electrode track on the image forming element. In principle, any bending and deformation in the transport direction can now be corrected.

In another embodiment, in an image printing apparatus wherein the image information signals define the value of pixels of an image divided into rows and columns of pixels wherein a row of pixels corresponds to the surface of all the electrode tracks covered simultaneously by the developing magnet during a minimum pixel printing period, the electronic image line correction means are adapted to replace image information signals of a row of pixels by image information signals of pixels of other rows in the same column. Instead of producing a shift with analog delay means, it can be effected more readily with image information stored in digital form. Stored image information can, for example, be read out later by a delay equal to a number of clock pulses determined by the magnitude of the image line correction.

A digital embodiment of this kind includes an electronic image line correction means which comprises: an image line correction memory for storing image information signals to be fed thereto, an input address generator for generating column and row addresses of the image line correction memory for writing therein image information signals of pixels of a number of consecutive rows of pixels, an output address generator for generating column and row addresses of the image line correction memory for reading therefrom image information signals of a row of pixels, a correction table for storing a shift of a row address of each pixel of a row, read-out means for reading from the image line correction memory and feeding to the electrode track activating means image information signals of a row of pixels in accordance with the column and row addresses generated by the output address generator and the column address shift stored in the correction table.

In this case the addressing of the read-out addresses is controlled by the image line correction so that the correct image information signal is sent to the electrode track activating means at the correct time.

A practical embodiment includes an electronic image line correction means comprising interpolation means for determining the shift of the row addresses of each pixel in a row on the basis of the shift of the row addresses of a limited number of pixels in a row as stored in the correction table. If a deformation in the print occurs locally in the form of a continuous curve, it is not necessary to store an image line correction value separately for each electrode track. In that case it is sufficient to store a limited number of image line correction values a specific distance apart and to calculate the intermediate values by interpolation. This results in a saving of image line correction memory.

In an image printing apparatus provided with scanner means for photo-electric scanning of an original sheet to produce image information signals, one advantageous embodiment is obtained if the image printing apparatus is provided with test print generating means for generating image information signals representing a test print to be reproduced by the image forming units, test print analysis means for comparing the image information signals produced by the scanner means in respect of the test print scanned by the scanner means, in order to generate image line correction signals to be fed to the image line correction means. This does away with the need for any additional means for determining the magnitude of the image line corrections. The scanner means, e.g. a CCD array, can then be used to measure any deviation of the color images relative to one another.

In another embodiment, the test print to be generated by the test print generation means comprises lines which extend in the direction of the axis of rotation of the image forming element and are reproduced by at least two different image forming units. By determining the difference in distance between such lines as a function of the axial position, the deformation of the one image forming element can be so corrected as to be equal to the deformation of the other image forming element.

In one embodiment, an average static deviation can be determined according to the invention in that the lines comprise line pairs spread over the entire image and of which a first line is reproduced by always a first image forming unit and a second line is reproduced by at least one other image forming unit. By averaging the deviations found over all the line pairs on one axial position, it is possible to allow for a deformation still dependent on the position in the direction of transport.

In a further embodiment, the test print to be generated by the test print generating means comprises position markers to determine location co-ordinates with respect to the position markers. In this way the test print analysis means can relate a measured line position to a co-ordinate system coupled to these position markers. By reference to the global position of a line on the test print it is now possible to determine the image forming unit which printed this line.

In another embodiment, the test print to be generated by the test print generating means comprises orientation markers for determining a correct orientation of the test print with respect to the scanner means. This prevents a test print from being fed to the scanner means in the wrong orientation.

In another advantageous embodiment, the test print analysis means comprises: first averaging means for determining an average row position of a scanned line on the basis of image information signals from different pixels of the line, difference determining means for determining a difference in averaged row position between lines formed by two different image forming units, second averaging means for determining an average difference in row position on the basis of a plurality of differences in row positions as determined over the entire image in a direction perpendicular to the axis of rotation of the image forming element. By determining the image line correction on the basis of position measurements of different pixels in a line rejects and variations in the measurements are filtered.

In an image printing apparatus wherein the scanner means generate image information signals for different colors, a reliable measurement is obtained in an embodiment wherein the test print analysis means make use of image information signals in one color. Any relative deformation produced by the different paths in the scanner means for the different colors then no longer influences the measurement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 11(A) and 11(B) show test patterns for determining the image line correction with an enlarged view of part of the test print of the test pattern as printed by the image printing apparatus;

DETAILED DESCRIPTION OF THE PREFERRED EMBODIMENTS

Hereinafter, a preferred embodiment of the present invention will be described with reference to the drawings.

Figures 1A, 1B:
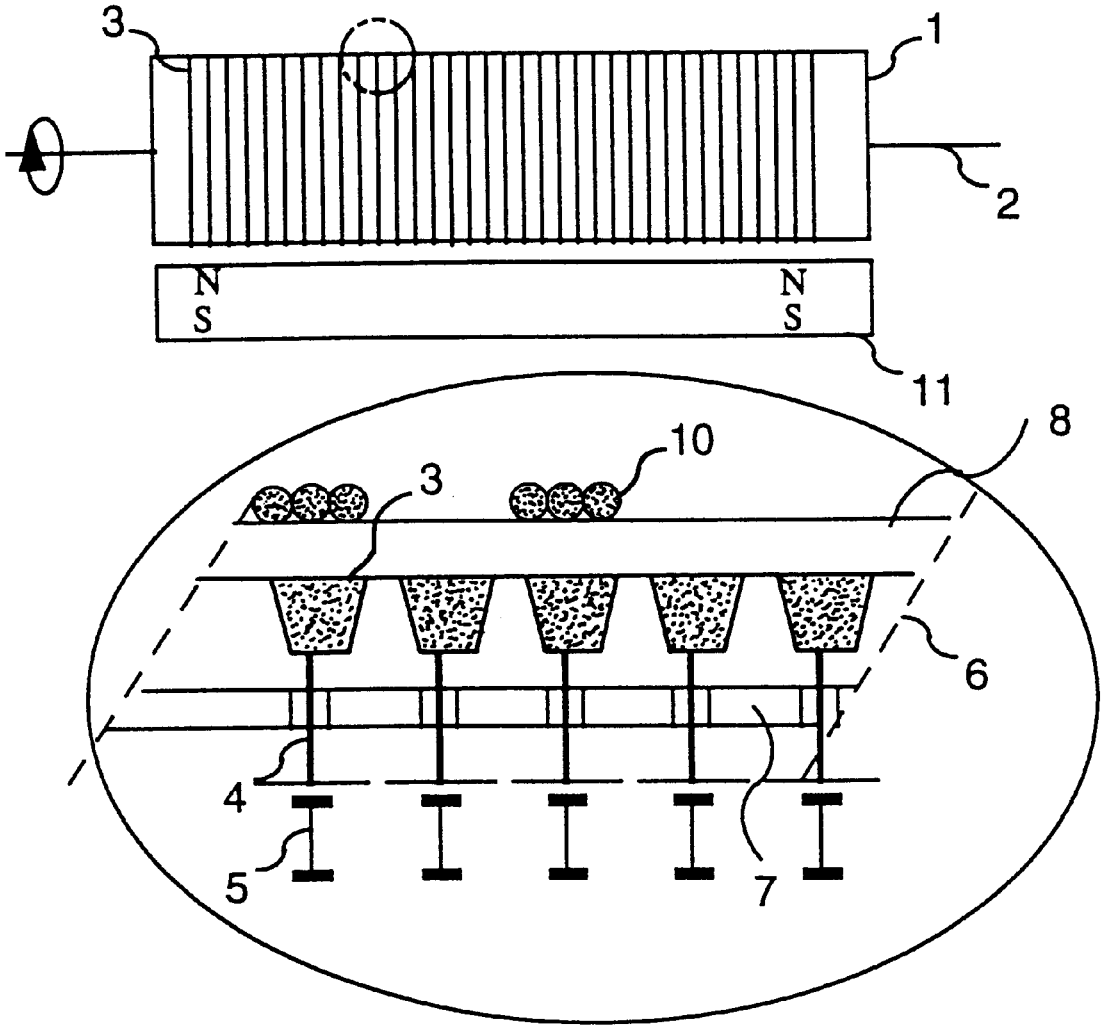
FIGS. 1(A) and 1(B) are views of an image forming element with an associated linear developing magnet.

FIGS. 1(A) and 1(B) show images forming element 1 as used in the image printing apparatus to be described hereinafter. The image forming element 1 is in the form of a cylindrical member 1 which is rotatable about an axis of rotation 2. The image forming element 1 is provided with peripherally extending parallel electrode tracks 3 at the outer surface. The enlarged view shows that these electrode tracks 3 are each separately connected via a conductive connection 4 to a separate voltage source 5. The electrode tracks 3 are embedded in electrically insulating material 6. The assembly is disposed on a cylindrical support part 7. The outer surface 8 consists of dielectric material. The width and spacing of the electrode tracks 3 determine the image resolution axially of an image of electrically conductive and magnetically attractable toner powder 10 to be formed on the image forming element 1. The width of an electrode track 3 in this construction is 45 micrometers with mutual spacing of 18.5 micrometers. There are 4944 electrode tracks 3 over a distance of 314 mm in the axial direction. This is equivalent to an axial resolution of 400 dpi (dots per inch). The diameter of the image forming element 1 is about 100 mm. Disposed opposite the image forming element 1 is a linear developing magnet 11, the direction of the length of which is parallel to the rotational axis 2. The magnetic field formed by the developing magnet 11 is peripherally narrow and sharply defined. The strength of the magnetic field between the developing magnet 11 and the image forming element 1 is sufficient, under specific conditions, to draw the magnetically attractable toner powder 10 from the image forming element 1. These conditions relate primarily to the presence of a minimal electric voltage difference between an electrode track 3 and the developing magnet 11. The electric force exerted as a result on the electrically conductive toner 10 present above the electrode track 3 can then predominate compared with the magnetic force. The resulting image formation is explained in detail with reference to FIG. 2.

Figure 2:
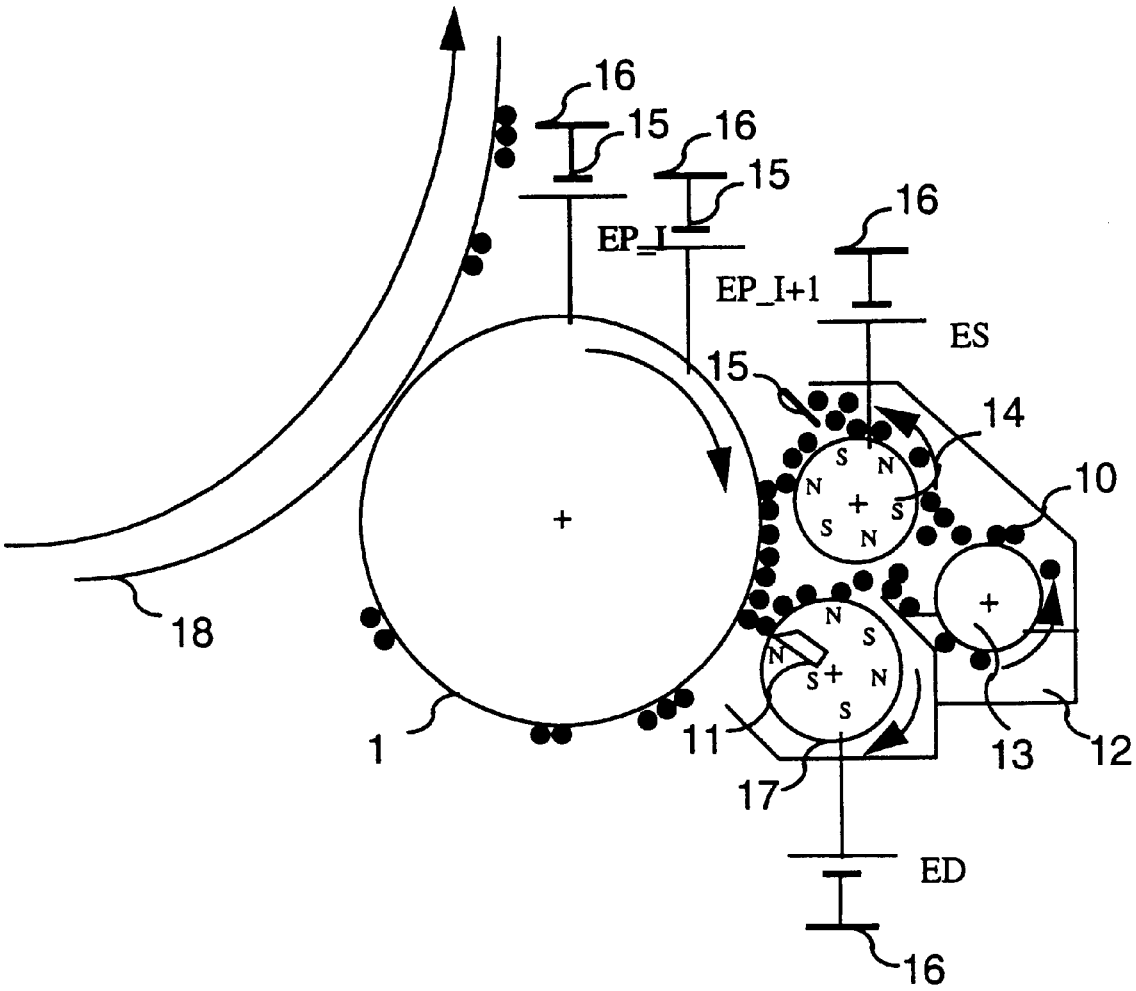
FIG. 2 shows an image forming unit with the image forming element of FIG. 1.

FIG. 2 shows an image forming unit comprising the image forming element 1 and the developing magnet 11. Toner 10 is fed from a toner reservoir 12 via a feed mill 13 rotatable in the direction indicated, to a magnetic feed roller 14 also rotatable in the direction indicated. An even layer of toner powder is formed on the feed roller 14 by means of a wiper 15, and is transferred to the image forming element 1 via a voltage difference between the feed roller 14 and the image forming element 1. For this purpose, the feed roller is kept at a feed voltage ES of +100 volts with respect to a reference earth (ground) 16 while a positive printing voltage EP of zero or +60 volts with respect to the reference earth 16 is maintained on the electrode tracks 3. As a result there is always a positive voltage difference between the feed roller 14 and the electrode tracks 3 of the image forming element 1. The dielectric surface layer 8 above the relevant electrode track will thus have a negative charge via the electrically conductive toner 10 present between the image forming element 1 and the feed roller 14. In this case the toner 10 will have a positive charge so that the toner 10 will locally continue to adhere to the image forming element 1.

The even layer of toner 10 thus applied to the image forming unit 1 is then advanced to the developing magnet 11 by rotation of the image forming unit 1 in the direction indicated. Disposed around the developing magnet 11 is a rotatable sleeve 17 which transports back to the toner reservoir 12 the toner attracted by the developing magnet 11 from the image forming element 1. Sleeve 17 is kept at a sleeve voltage EH of +40 volts with respect to the reference earth 16. As already stated, a printing voltage EP of +40 volts with respect to the reference earth 16 can be applied to each electrode track 3. In that case there is no voltage difference between the sleeve 17 and the electrode track 3. The toner 10 present above this electrode track 3 will then be pulled over to the sleeve 17 by the magnetic force produced by the developing magnet 11 and be transported to the toner reservoir 12. If, on the other hand, a printing voltage EP of zero volts is applied to an electrode track 3, the electrode 3 has a positive voltage difference of 40 volts with respect to the sleeve 17. The electric force thus exerted on the positively charged toner 10 then predominates over the magnetic force exerted by the developing magnet 11. The toner present above the electrode track 3 will then stay on the image forming element 1 and be transported on to an image collecting element 18. By applying a printing voltage EP of zero volts to an electrode track during a specific printing period, a toner coverage can be obtained whose magnitude in the direction of rotation is defined by the magnitude of the printing period.

Figure 3:
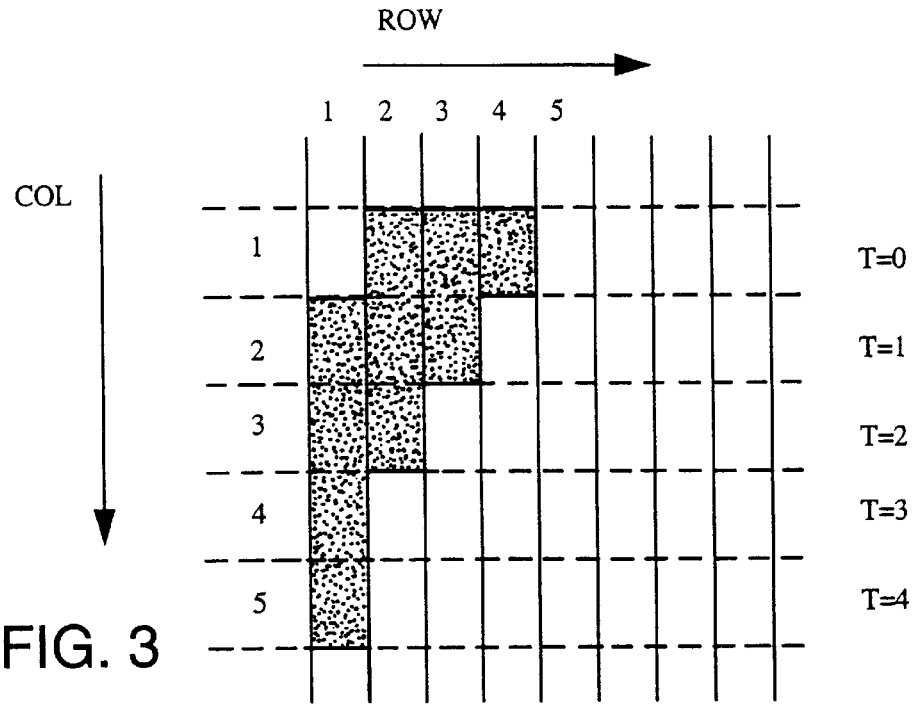
FIG. 3 is an example of a toner image printed by the image forming unit of FIG. 2.

FIG. 3 is an example of a toner covering obtained after the application of printing voltages of varying times. In this case the ROW direction corresponds to the axial direction of the image forming element 1 and the direction COL corresponds to the direction of rotation of the electrode tracks 3. During the time indicated by T=0, only the electrode tracks indicated by 2, 3 and 4 have been provided with a printing voltage during which toner powder is retained. During the period T=1 the electrode tracks concerned are 1, 2 and 3. The resulting toner coverings with defined minimal dimensions as determined by the width of the electrode track and the minimal printing period are indicated as pixels which in the direction indicated by ROW form a row of pixels and in the direction indicated by COL a column of pixels.

Figure 4:
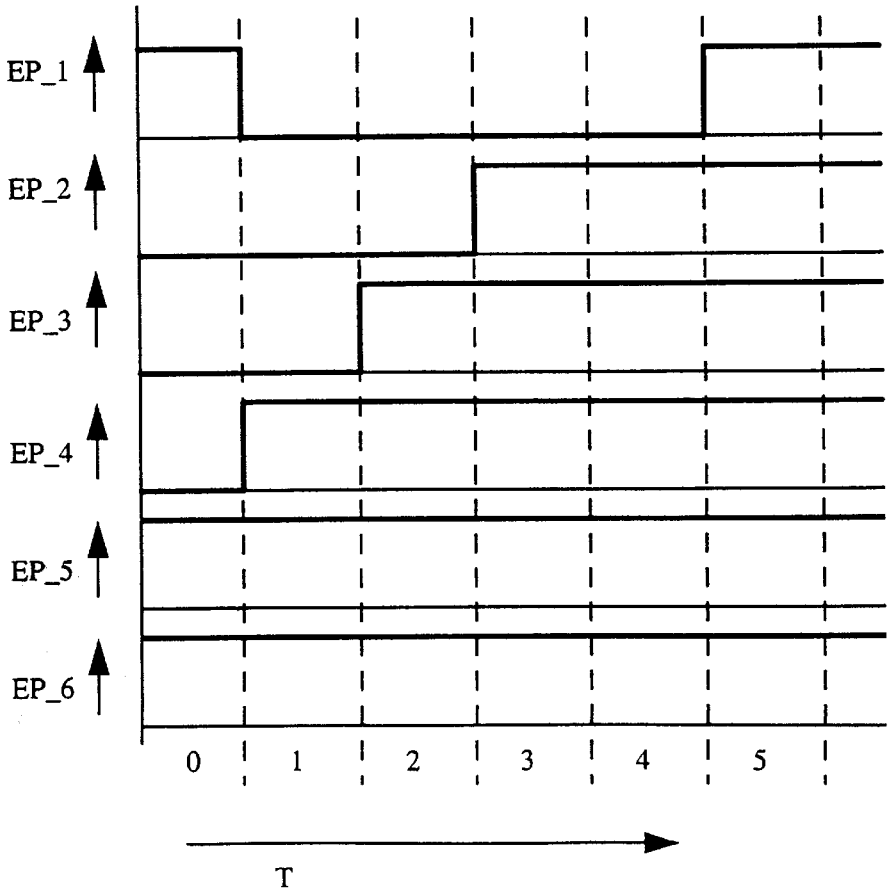
FIG. 4 shows the printing voltages required for the image forming unit of FIG. 2 in order to reproduce the toner image shown in FIG. 3.

FIG. 4 is a graph showing printing voltages EP_1 to EP_6 of the electrode tracks numbered 1 to 6, against the printing periods T, resulting in the toner coverage shown in FIG. 3. The minimal value for the printing voltage produces a toner coverage while the maximal value for the printing voltage does not produce any toner coverage.

It should also be noted that although toner is applied as a full surface to the image forming element 1 in the embodiment described here, and is selectively withdrawn therefrom, toner can also be applied selectively via the sleeve 17 around the linear developing magnet 11. One embodiment of this is also described in European Patent 0 301 209.

Figure 5:
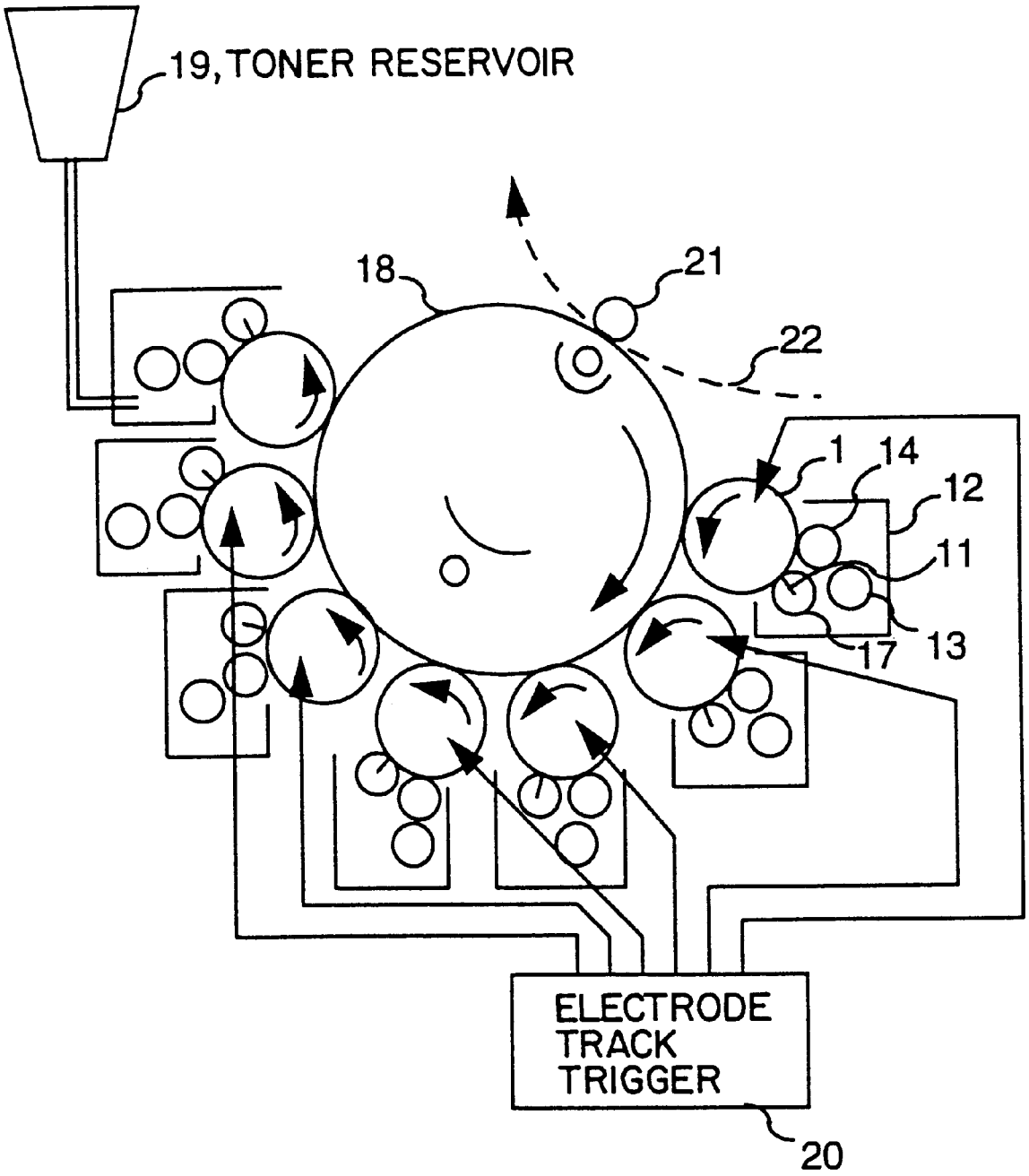
FIG. 5 shows part of an image printing apparatus provided with different image forming units as shown in FIG. 2.

A number of the image forming units described in FIG. 2 is required to reproduce a color image. FIG. 5 shows a construction of a seven-color image printing apparatus in which seven of these image forming units are arranged around a central cylindrical image collecting element 18. The directions of rotation of the various image forming elements 1 and the image collecting element 18 are shown in the drawing. Each image forming unit, with units as numbered in FIG. 2, is provided with a specific color toner by a separate toner reservoir 19. In the case of four-color printing, for example, C (cyan), M (magenta), Y (yellow) and K (black), and in the case of seven-color printing supplemented by R (red), G (green) and B (blue). Correct timing of these units with printing voltages EP for each image forming unit separately by electrode track trigger means 20 is essential for good alignment on the image collecting element 18 of color separation images formed by the various image forming units. The color separation images collected in alignment in one revolution of the image collecting element 18 are then simultaneously transferred to a paper sheet by suitable transfer means, such as a biasing roller 21. The transport path and transport direction 22 of the paper sheet is denoted by the broken-line arrow.

Figure 6:
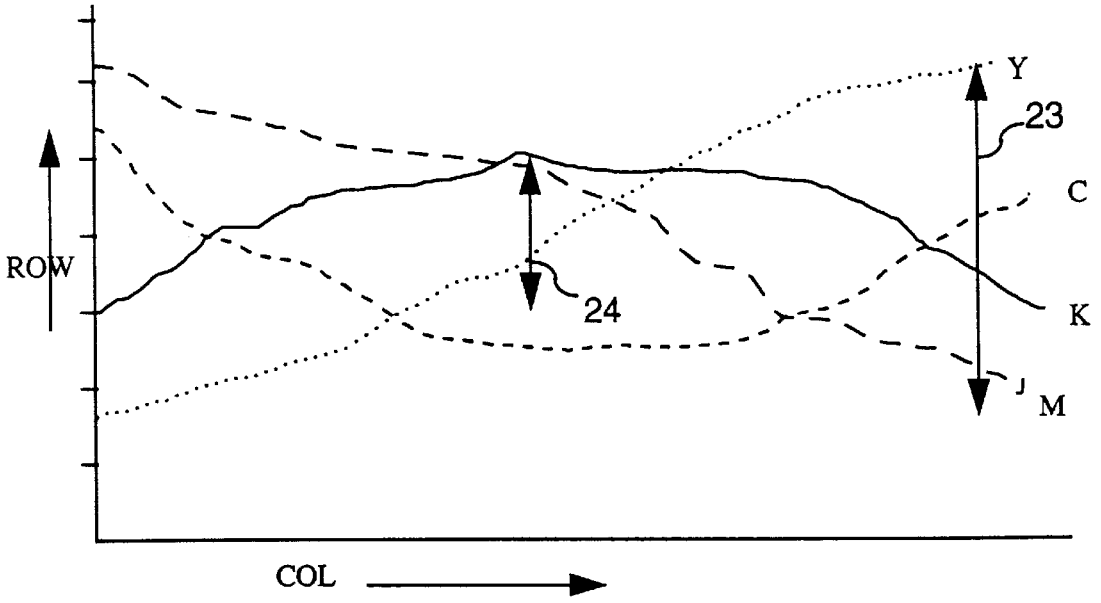
FIG. 6 shows prints of a coincident straight line without image line correction as generated by different image forming units.

In practice, the color separation images printed by a color image printing apparatus of this kind have been found not to be perfectly in register. Particularly in the direction parallel to the electrode tracks, a shift has been found to occur in printed pixels so that a row of pixels parallel to the axis of rotation is not printed along a straight line. In FIG. 6, a shift of this kind in the printed row position ROW as measured in the electrode track direction is plotted against the axial column position COL of an electrode track 3 on the developing element 1 of lines printed in the colors C, M, Y and K by four different image forming units. Apart from local variations in position, a global skewing and/or bending occurring over the entire dimension of the image forming element 1 are characteristic. It should be clear that the maximal skewing error 23 and bending error 24 cannot be completely corrected simply by shifting a time at which the image forming units are provided with printing voltages EP. The shifts are largely caused by the non-linearity of the magnetic field generated by the developing magnet 11. An additional factor is the dynamic behavior of the toner accumulation between the developing magnet 11 and the image forming element 1.

Although it is possible to try to achieve an optimal mechanical construction, this has its effect on the costs for the purchasers. In contrast, a fixed individual electronic image line correction for each electrode track 3 separately has been selected in the image printing apparatus according to the invention, since inasmuch as the shifts are reproducible over at least a specific period of time, the printing voltage EP to be applied for each electrode track can be shifted with a fixed individual image line correction time.

Figure 7:
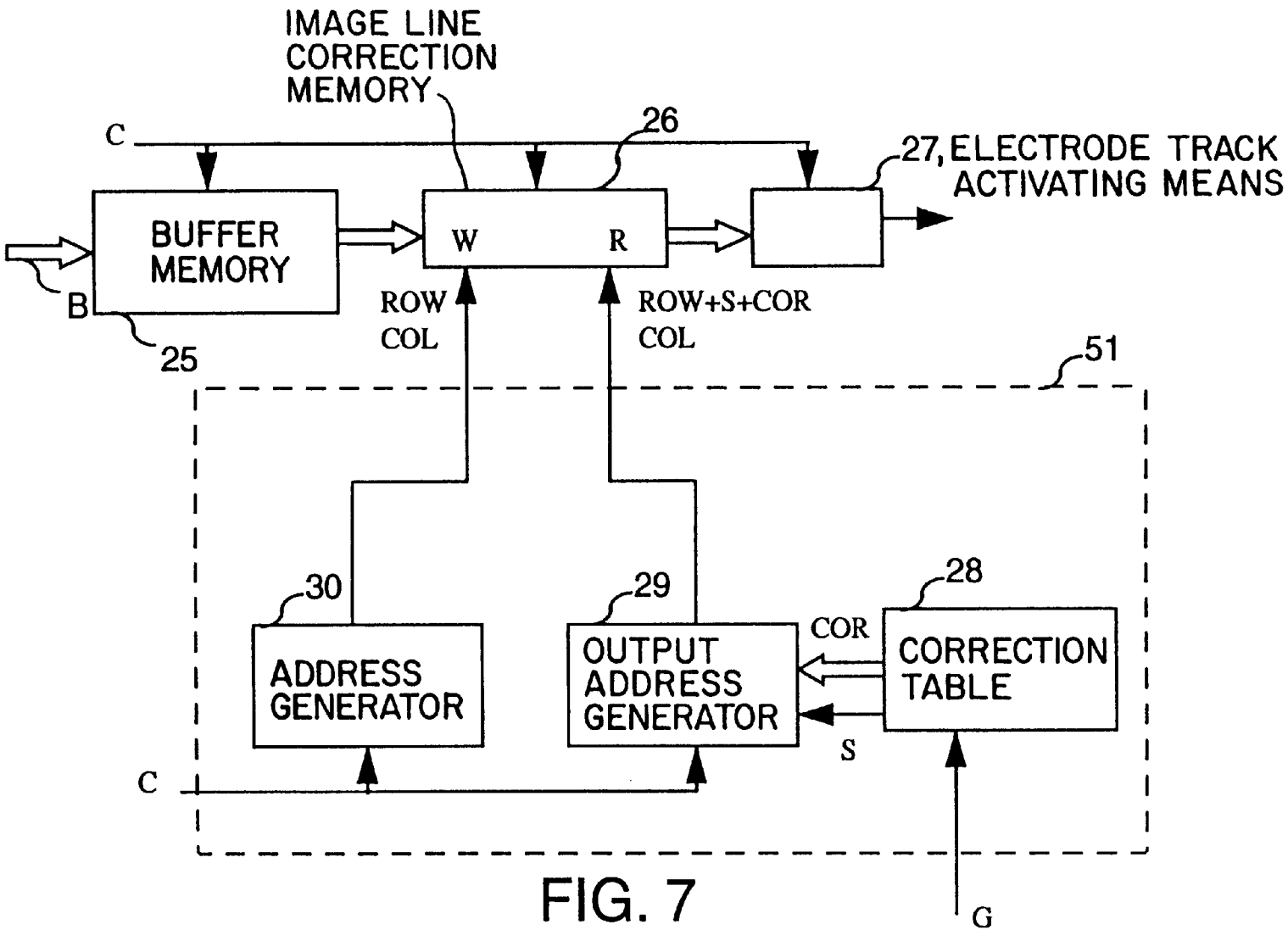
FIG. 7 shows electronic image line correction means for performing an image line correction.

FIG. 7 shows one possible embodiment of an individual image line correction of this kind for each electrode track 3 for an image forming unit. Image information signals B, which define the image of pixels for printing by means of a succession of print voltages EP are in this case fed to a buffer memory 25. These image information signals B have been generated previously in an image processing step suitable for the purpose, on the basis of image information generated, for example, by a scanner or text make-up station. One known image processing step in this connection is the conversion or half-toning of multi-value grey level information, for example, to binary printing information in the case of a printing apparatus which can reproduce only two surface coverings per pixel. The function of the buffer memory 25 is to be able so to select the activation of an image forming unit that given at least one straight leading edge the leading edges of color separation images formed by all the image forming units coincide.

For the purpose of an individual image line correction of the generation of a printing voltage for an electrode track 3 separately, an additional image line correction memory 26 is provided. This memory 26 in practice only has to comprise simultaneously image signals B from a limited number of image lines or rows of pixels. These are written in successively and read out again after some time. The required number of image lines is in this case defined by the size of a maximum permissible image line correction. It is characteristic of this image line correction memory 26 that it is possible not only to read and write in independently of one another via a column address COL and a row address ROW, but also read out an arbitrary row address ROW in the case of a specific column address COL. This offers the possibility of selecting image signals B originating from different row addresses ROW when activating the electrode track activating means 27 for reproducing a row of pixels. A shift perpendicular to the row direction can thus be corrected. The image line correction COR of a row address ROW is fed from a correction table 28 to an output address generator 29, which provides addressing for read-out of the image line correction memory 26. An input address generator 30 generates the addresses for writing into the image line correction memory 26. The correction table 28 generates in principle for each column address COL an image line correction COR for the corresponding row address ROW. In addition, a constant shift S in the row address ROW is maintained in order to keep the image line correction memory 26 full of image signals B in order to have available a sufficient number of image signals B of different row addresses. The various units are synchronized in time by means of clock signals C fed thereto. It should be apparent that there is a fixed relationship between the time of successive clock signals C and a time of a minimal printing voltage.

Figures 8, 9:
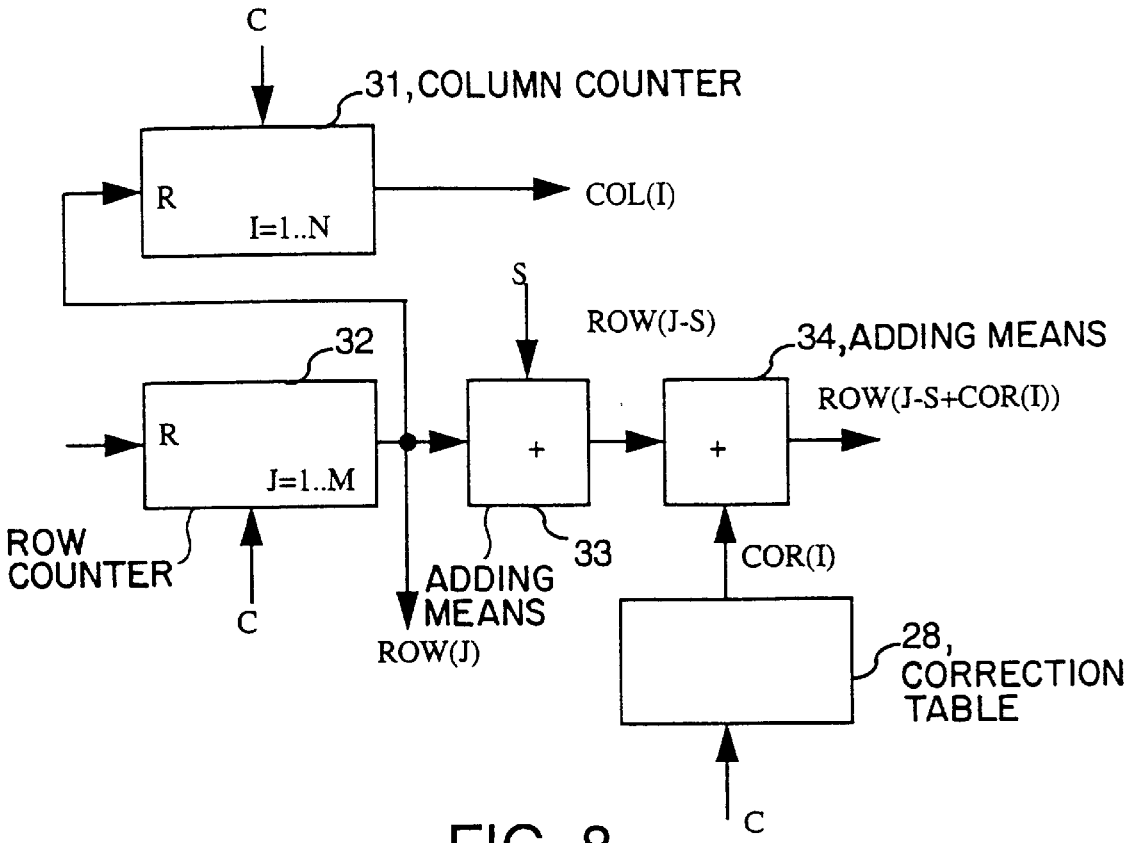
FIG. 8 shows an input and output address generator for generating corrected line and column addresses for the electronic image line correction means.
FIG. 9 is an example of addresses generated by the input and output address generator shown in FIG. 8.

FIG. 8 shows one possible embodiment of the address generators 29 and 30 of FIG. 7 for generating row addresses ROW and column addresses COL. A column generator 31 generates for N possible electrode tracks 3 with I as the index for a column, the column addresses COL (I). After generation of N column addresses the column counter 31 is reset by a reset signal fed to a reset input R. A row counter 32 generates M row addresses ROW(J) where J is the index for a row.

The output of the row counter 32 is connected to the reset input of column counter 31 so that on generation of one row address ROW(J), N associated column addressees COL(I) are generated. A control unit (not shown) provides the row counter 32 with a reset signal at the reset input R. The addresses thus generated by the two counters 31 and 32 are then used as writing addresses for writing in the image line correction memory 26. With regard to the columns, the output signal COL(I) originating from the column counter 31 is also used for reading out of the image line correction memory 26. The row addresses ROW for reading are obtained by increasing the output signal ROW(J) from the row counter 32 by a fixed number S and with a column I dependent image line correction COR(I) via adding means 33. This image line correction COR(I) is generated by a correction table via adding means 34.

FIG. 9 gives an example of a succession of addresses as generated by an address generator of this kind. The generated row writing addresses ROW, the corresponding shifted row read addresses ROW+S and the corresponding and corrected shifted row-read addresses ROW+S+COR are shown for the first two columns 1 and 2 and the last column N in columns from left to right for three successive clock pulses C. In this example it is expected that the maximum size of the image line correction perpendicular to the row direction will not extend over more than five rows. The magnitude of the fixed shift S is therefore equal to 5. The image line corrections COR for the three column addresses in this example are 1, 3 and 1 row positions.

Figure 10:
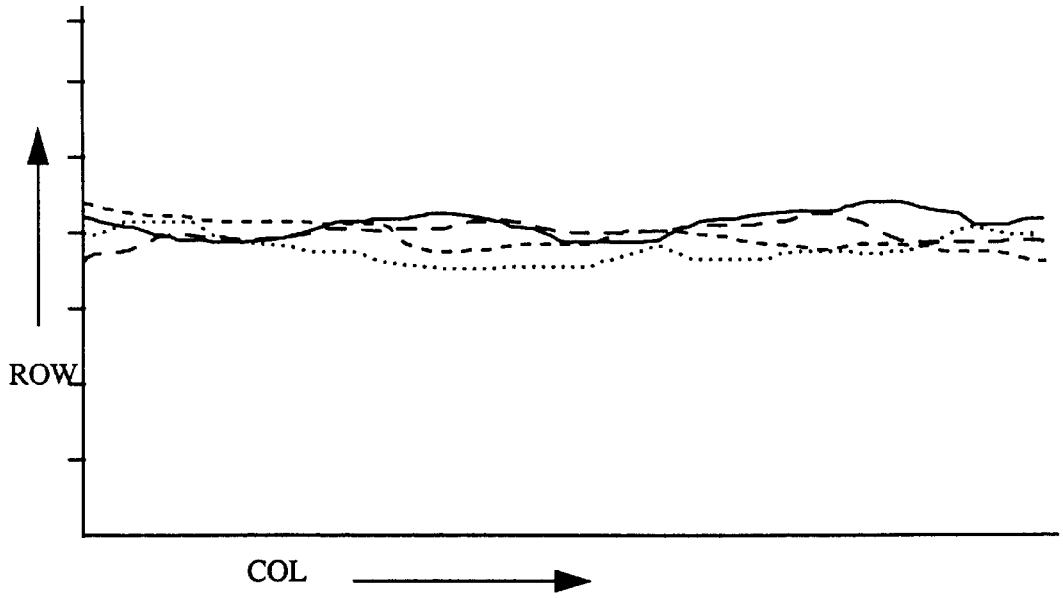
FIG. 10 shows prints of a coincidence straight line printed by different image forming units as obtained after image line correction.

FIG. 10 is an example of how after an image line correction of this kind the coinciding lines printed in the row direction by the various image forming units still differ in location from one another. The differences still present come within the minimum image line correction distance of, for example, one row spacing and are attributed to a non-static disturbance.

A test measurement is necessary to determine the image line correction required. For this, a straight line printed by each image forming unit without image line correction can be compared with an absolute reference line in order thus to find a measurement for the deviation per image forming unit. However, this frequently necessitates supplementary measuring equipment. One advantageous embodiment using image-scanning scanner means present in the printing apparatus will now be described.

For this, use is made of a test print 35 as shown in FIGS. 11(A) and 11(B) printed by the apparatus itself, for example from a memory. In this case, lines 37 and 38 are present over the entire dimension of the test print 35, their length direction being parallel to the linear developing magnet of the associated image forming unit. This therefore corresponds to the direction of a row of pixels. By dividing the lines 37 and 38 over the entire image it is possible to obtain image information concerning a variation of any bending present in the row direction over the entire image. By means of orientation markers 36 printed at the same time, this test print 35 can be scanned by suitable scanner means in a distinct orientation and the image information can be stored. Position markers 39 also printed relate the scanned lines 37 and 38 to a co-ordinate system defined by these position markers 39. In this way it is possible to relate each scanned line 37 and 38 to an image forming unit which printed it.

The enlarged-scale view diagrammatically shows that the lines 37 and 38 are arranged in pairs always of two adjacent lines 37 and 38 of which the first line 37 is always printed with the same image forming unit and the second line 38 always with another image forming unit. Only line pairs from the same two image forming units are present in a row. In a direction perpendicular to the line pairs, i.e. the column direction or transport direction, the second line 38 of a line pair is always printed by another image forming unit. In the case of a seven-color printer, there is a repetition of six line pairs always in the column direction, of which the second line 38 of a line pair in a row is always printed by another image forming unit. In practice, the image forming unit for black is used to reproduce the first line 37 of a line pair and the other image forming units are used for the second line 38 of a pair.

In the case of an A4 paper sheet with the length direction parallel to the row direction, there is a number of 150 lines in the row direction and a number of 100 lines in the column direction. The thickness of a line in this case is a few millimeters. This is equivalent to 75 line pairs in the row direction. In the case of a seven-color printer, there are 25 measuring points in the column direction distributed over the entire image.

As shown on an exaggerated scale in the enlarged view, in practice without image line correction the lines 37 and 38 differ from one another always in respect of position in the column direction. By now defining with the scanner means the average deviation in position expressed in rows in the column direction between the lines of each line pair 37 and 38 it is possible to define the magnitude of the deformation in the column direction by the various image forming units with respect to, for example, the image forming unit for black.

Figure 12:
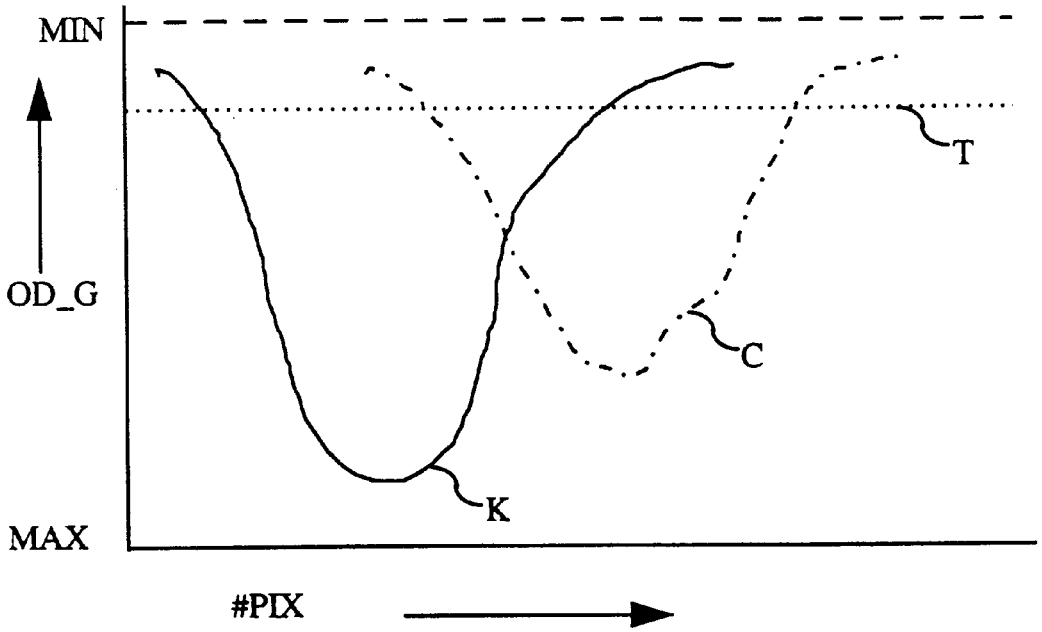
FIG. 12 shows the measured surface coverage of a line pair in the test print of FIG. 11 as considered in the direction of transport.

FIG. 12 shows an example of a measurement of a surface covering OD_G in the direction of a column as measured by the color channel for green of an RGB color scanner of a line pair 37 and 38 with the first line 37 reproduced by the image forming unit for black (K) and the second line 38 reproduced by the image forming unit for cyan (C). The measured surface covering of the black line is indicated by K, that for the cyan line by C. It should be noted that the position of all the lines is always measured by means of the same color channel of the color scanner. Any deviation in linearity due to the differences between the scanner channels is then precluded. The surface covering OD_G is shown as a function of the number of pixels #PIX in the column direction. In practice, a line 37 or 38 covers tens of pixels in the column direction. By thresholding with a threshold value T the background level is filtered out and a coverage is obtained as shown in FIG. 13.

Figure 13:
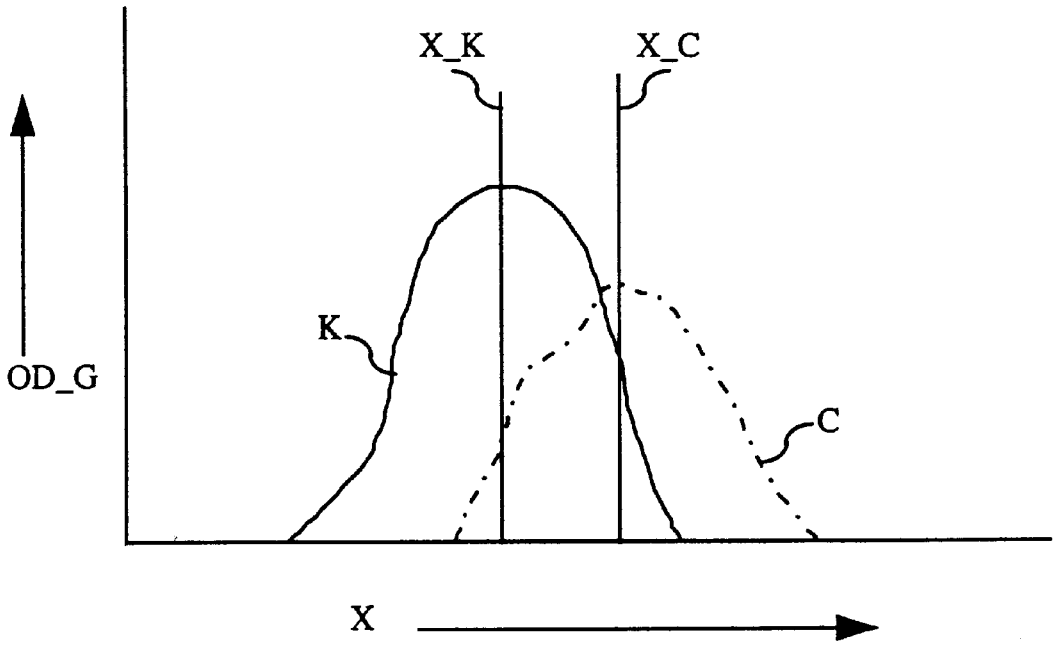
FIG. 13 shows the average positioning of the lines in the line pair shown in FIG. 12.

FIG. 13 shows the average position X_K and X_C of the position in the column direction of the lines for K for black and C for cyan. These are obtained by dividing the product of the surface coverage OD_G with the pixel position X in the column direction by the total surface coverage. Thus each of the two lines K and C is given an average column position X_K and X_c with locally the register error known as the difference between these two values.

Figure 14:
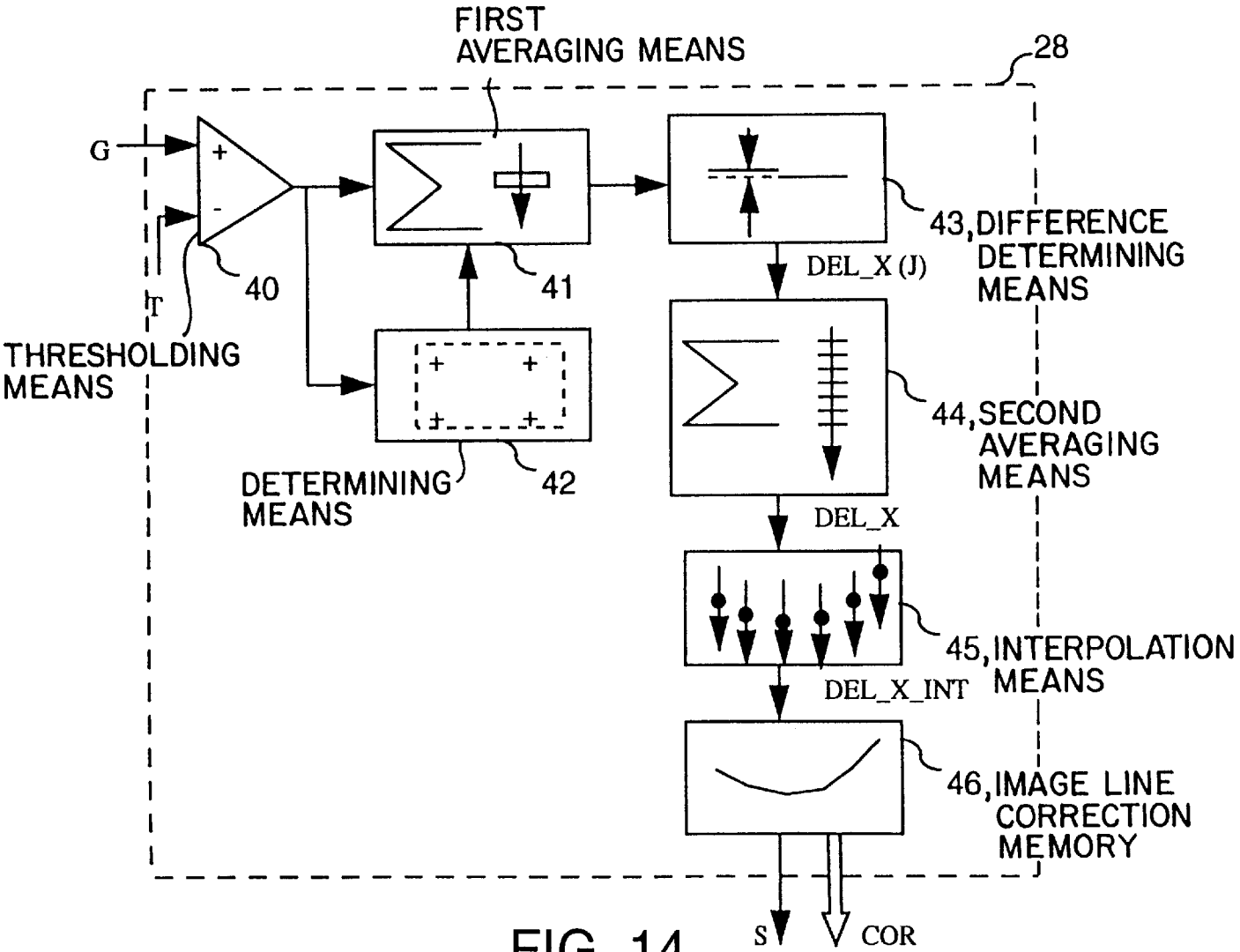
FIG. 14 shows test print analysis means for determining the magnitude of the image line correction on the basis of the test print printed by the image forming units.

FIG. 14 shows an embodiment of the test print analysis means 28 suitable for analyzing a scanned test print and determining the image line correction derived therefrom. As already stated, the image signal G of the green color channel is used. Suitable thresholding means 40 remove a background level from signal G by removing everything that remains below the threshold value T. The thresholded signal T-G is then fed to first averaging means 41 to define the average position X in the column direction of a line 37 or 38 as shown in FIGS. 12 and 13. The thresholded signal T-G is also fed to location determining means 42 in order to relate a line 37 or 38 to an image forming unit by reference to the position markers 39. On the basis of the average position X thus determined, the differences DEL_X(J) in position in the column direction of lines of each line pair are determined by a difference determining means 43. Second averaging means 44 also again average the resulting values in the column direction over the entire image dimension in the column direction. Thus for each measured column position I an average position error DEL_X of each color is defined with respect to black. An interpolated value is determined by interpolation means 45 for the column positions that have not been measured. These values are finally stored in an image line correction memory 46.

Figure 15:
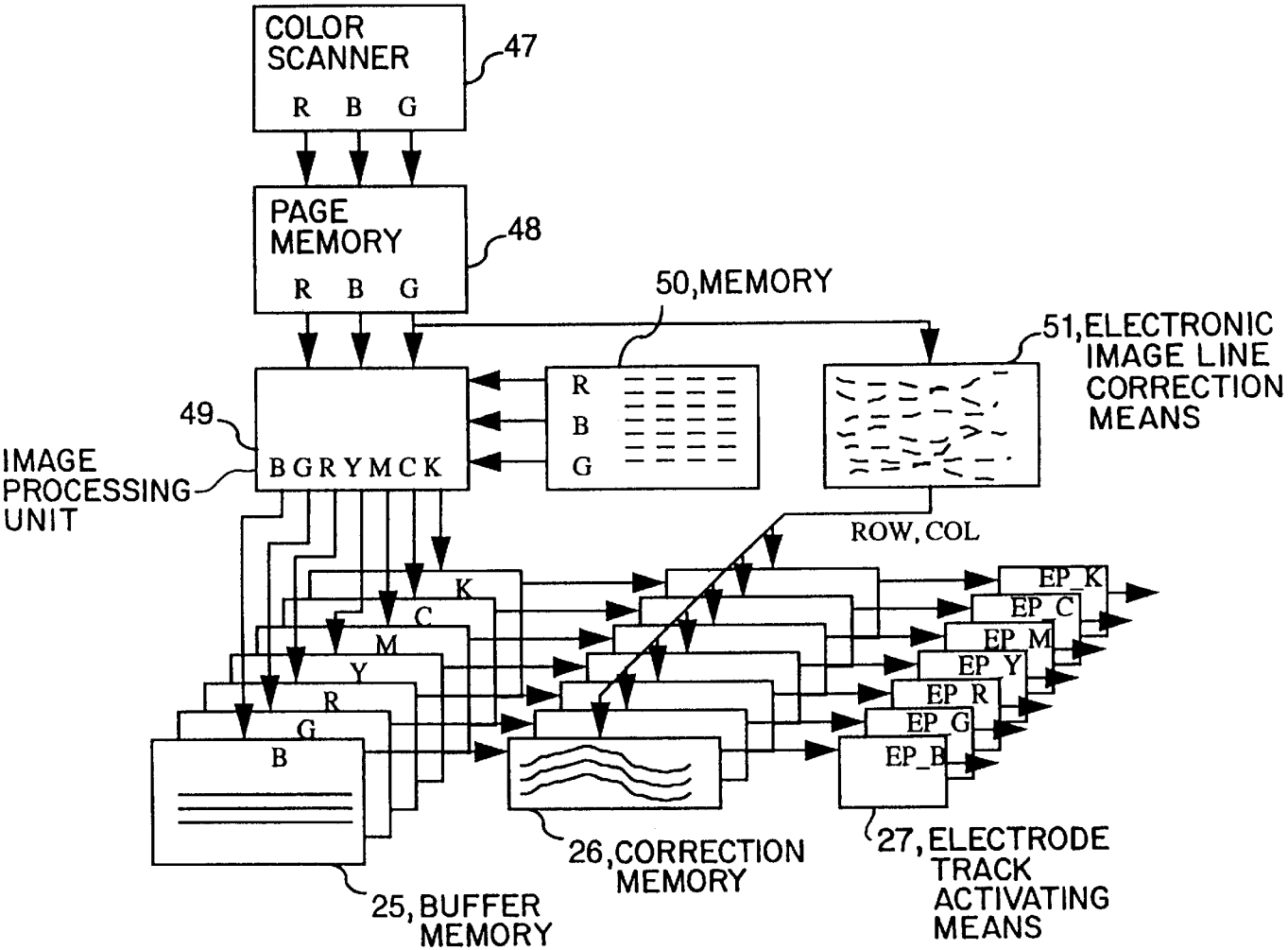
FIG. 15 shows the position of the test print generating means, test print analysis means and image line correction means in an image printing apparatus with different image forming units.

FIG. 15 is an overall view of the data stream of a seven-color printer with the image line correction means according to the invention. Here the image information signals are supplied by an RGB color scanner 47 whereafter the image signals are stored in a page memory 48. The RGB image signals are then separated in an image processing unit 49 and half-toned in the seven print colors R, G, B, C, M, Y, and K. The resulting color separation image signals are then stored in separate buffer memories 25. Given suitable choice of the read-out time for each of these buffer memories 25 the various color separation images are placed in alignment in the same position on the image collecting member 18. The information for reproducing a test print is generated from a memory 50 shown separately. The image signals for the test print are fed in the form of RGB signals to the image processing means 49, whereby they are converted to the seven print colors. The image signals stored in the buffer memories 25 are fed at defined times to smaller image line correction memories 26. These are required at maximum to store simultaneously only a few image lines. The read-out of these image line correction memories 26 is controlled by the electronic image line correction means 51 shown in detail in FIGS. 7 and 14. These electronic image line correction means 51 generate the correct row and column addresses ROW and COL for the purpose. The image signals associated with these addresses are then fed to the electrode track activating means 27.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An image printing apparatus comprising a number of image forming units for forming toner images of different colors in alignment on an image receiving material in accordance with electronic image information signals fed to each image forming unit, wherein each image forming unit comprises:

an image forming element rotatable about an axis of rotation and provided with a dielectric surface layer with electrode tracks therebeneath;

developing means comprising a linear developing magnet situated near the outer surface and parallel to the axis of rotation of the image forming element;

toner feed means for feeding electrically conductive and magnetically attractable toner powder to the image forming element; and electrode track activating means for applying a first or a second printing voltage between an electrode track and the magnet system in accordance with the image information signals to be fed to the image forming units, toner powder on the passage of the electrode track along the developing magnet either remains on the image forming element or does not remain thereon in accordance with a first or second printing voltage respectively on the electrode track, at least one image forming unit includes electronic image line correction means for feeding image line correction signals to the electrode track activating means in order to shift in time for each electrode track a printing period in which a printing voltage is applied to the electrode track in accordance with an image information signal.

2. The image printing apparatus according to claim 1, wherein the magnitude of the shift of the printing period for each electrode track is directly proportional to the axial position of the electrode track on the image forming element.

3. The image printing apparatus according to claim 1, wherein the magnitude of the shift of the printing period for each electrode track is dependent of the axial position of the electrode track on the image forming element.

4. The image printing apparatus according to claim 1, wherein the image line correction signals to be fed to at least one image forming unit by the image line correction means give an image line correction relative to one image forming unit serving as a reference.

5. The image printing apparatus according to claim 4, wherein the image printing apparatus is provided with an image forming unit for reproducing the color black, the image forming unit for reproducing the color black serves as a reference unit.

6. The image printing apparatus according to claim 1, wherein the image information signals define the value of pixels of an image divided into rows and columns of pixels wherein a row of pixels corresponds to the surface of all the electrode tracks covered simultaneously by the developing magnet during a minimum pixel printing period, the electronic image line correction means are adapted to replace image information signals of a row of pixels by image information signals of pixels of other rows in the same column.

7. The image printing apparatus according to claim 6, wherein the electronic image line correction means further comprises:

an image line correction memory for storing image information signals to be fed thereto;

an input address generator for generating column and row addresses of the image line correction memory for writing therein image information signals of pixels of a number of consecutive rows of pixels;

an output address generator for generating column and row addresses of the image line correction memory for reading therefrom image information signals of a row of pixels;

a correction table for storing a shift of a row address of each pixel of a row; and read-out means for reading from the image line correction memory and feeding to the electrode track activating means image information signals of a row of pixels in accordance with the column and row addresses generated by the output address generator and the column address shift stored in the correction table.

8. The image printing apparatus according to claim 7, wherein the electronic image line correction means comprises interpolation means for determining the shift of the row addresses of each pixel in a row on the basis of the shift of the row addresses of a limited number of pixels in a row as stored in the correction table.

9. The image printing apparatus according to claim 1, further comprising: scanner means for photo-electric scanning of an original sheet to produce image information signals;

test print generating means for generating image information signals representing a test print to be reproduced by the image forming units; and test print analysis means for comparing the image information signals produced by the scanner means in respect of the test print scanned by the scanner means, in order to generate image line correction signals to be fed to the electronic image line correction means.

10. The image printing apparatus according to claim 9, wherein the test print to be generated by the test print generation means comprises lines which extend in the direction of the axis of rotation of the image forming element and are reproduced by at least two different image forming units.

11. The image printing apparatus according to claim 10, wherein the lines comprise line pairs spread over the entire image and of which a first line is always reproduced by a first image forming unit and a second line is reproduced by at least one other image forming unit.

12. The image printing apparatus according to claim 9, wherein the test print to be generated by the test print generating means comprises position markers to determine location co-ordinates with respect to said position markers.

13. The image printing apparatus according to claim 9, wherein the test print to be generated by the test print generating means comprises orientation markers for determining a correct orientation of the test print with respect to the scanner means.

14. The image printing apparatus according to claim 10, wherein the test print analysis means comprises:

first averaging means for determining an average row position of a scanned line on the basis of image information signals from different pixels of the line;

difference determining means for determining a difference in average row position between lines formed by two different image forming units; and second averaging means for determining an average difference in row position on the basis of a plurality of differences in row positions as determined over the entire image in a direction perpendicular to the axis of rotation of the image forming element.

15. The image printing apparatus according to claim 9, wherein the scanner means generate image information signals for different colors, test print analysis means processes image information signals of one color.

16. The image printing apparatus according to claim 2, wherein the image line correction signals to be fed to at least one image forming unit by the image line correction means give an image line correction relative to one image forming unit serving as a reference.

17. The image printing apparatus according to claim 3, wherein the image line correction signals to be fed to at least one image forming unit by the image line correction means give an image line correction relative to one image forming unit serving as a reference.

18. The image printing apparatus according to claim 2, wherein the image information signals define the value of pixels of an image divided into rows and columns of pixels wherein a row of pixels corresponds to the surface of all the electrode tracks covered simultaneously by the developing magnet during a minimum pixel printing period, the electronic image line correction means are adapted to replace image information signals of a row of pixels by image information signals of pixels of other rows in the same column.

19. The image printing apparatus according to claim 3, wherein the image information signals define the value of pixels of an image divided into rows and columns of pixels wherein a row of pixels corresponds to the surface of all the electrode tracks covered simultaneously by the developing magnet during a minimum pixel printing period, the electronic image line correction means are adapted to replace image information signals of a row of pixels by image information signals of pixels of other rows in the same column.

20. The image printing apparatus according to claim 4, wherein the image information signals define the value of pixels of an image divided into rows and columns of pixels wherein a row of pixels corresponds to the surface of all the electrode tracks covered simultaneously by the developing magnet during a minimum pixel printing period, the electronic image line correction means are adapted to replace image information signals of a row of pixels by image information signals of pixels of other rows in the same column.

* * * * *